United States Patent [19]

Zittell

[11] Patent Number: 5,020,276

[45] Date of Patent: Jun. 4, 1991

[54] WOODEN MOVABLE LOUVER SHUTTERS

[76] Inventor: Frank F. Zittell, 1734 Buchanan St., Hollywood, Fla. 33020

[21] Appl. No.: 484,545

[22] Filed: Feb. 26, 1990

Related U.S. Application Data

[63] Continuation-in-part of Ser. No. 205,921, Jun. 13, 1988, abandoned.

[51] Int. Cl.[5] ..... E05F 17/00

[52] U.S. Cl. ..... 49/87; 49/92

[58] Field of Search ..... 49/87, 88, 90, 92, 74, 49/359; 292/345; 160/236, 176–181; 403/53, 57, 78, 213, 209; 98/121.1

[56] References Cited

U.S. PATENT DOCUMENTS

| | | | |
|---|---|---|---|
| 126,713 | 5/1872 | Kelly | 49/92 |
| 188,908 | 3/1877 | Hopkins et al. | 49/92 X |
| 206,088 | 7/1878 | Davis | 292/345 |
| 357,277 | 2/1887 | Fawcett | 49/87 |
| 2,329,868 | 9/1943 | Wood | 49/92 |
| 4,509,290 | 4/1985 | Stanfield, Jr. | 49/92 |
| 4,655,003 | 4/1987 | Henley, Sr. | 49/74 X |

FOREIGN PATENT DOCUMENTS

| | | | |
|---|---|---|---|
| 1903727 | 9/1969 | Fed. Rep. of Germany | 49/90 |
| 938857 | 3/1949 | France | 49/74 |
| 206649 | 8/1939 | Switzerland | 49/90 |

*Primary Examiner*—James R. Brittain

[57] ABSTRACT

A shutter assembly comprising a plurality of vertically spaced, horizontally extending louvers rotating between a pair of opposed vertical side rails causing them to control the light and air passing through the shutter from a maximum, when in the open position, to a minimum, when in the closed position. All parts are made primarily of wood. The pivoting movement is in response to the operation of a tilt rod containing "U" shaped, malleable metal staples coupled with similar staples inserted into each louver, and of a type normally used. Both sets of staples are crimped as close as possible to their junction points so that they become two interlocking eyelets. When the shutter is in the upright position and the louvers are closed, the surface of the louver facing the observer is considered the front surface and the margin containing the staple, the upper margin. From a position about half way down the upper margin there is a slightly angled slope which intersects the rear surface of the louver. There is a rabbet formed in the lower margin, front surface of the louver into which the upper margin of the adjoining louver dovetails when the louvers are closed. This rabbet consists of one side extending perpendicularly from the front surface of the louver to where it intersects another side sloping parallel to the slope formed in the upper margin. All extremities are rounded.

12 Claims, 3 Drawing Sheets

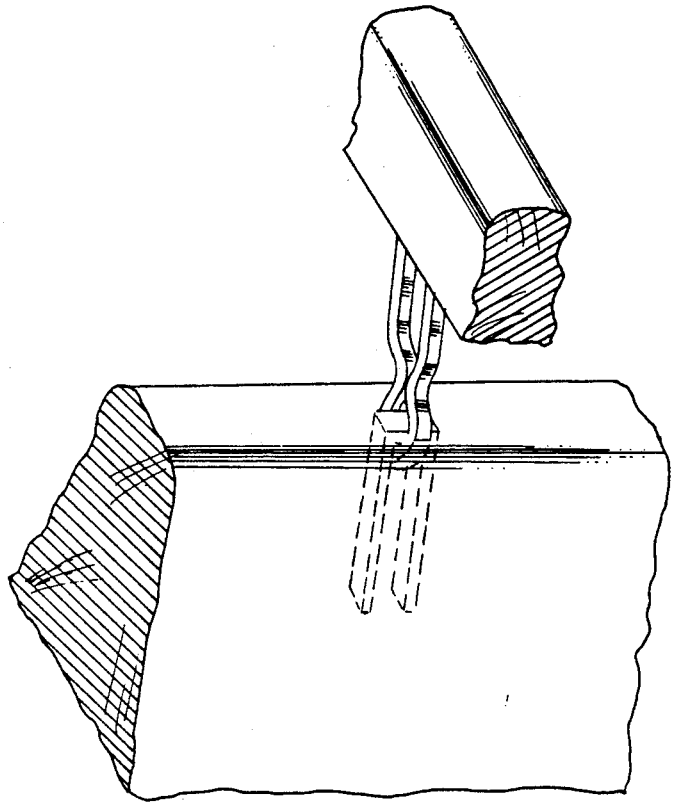
FIG. 4
(PRIOR ART)
FIG. 5
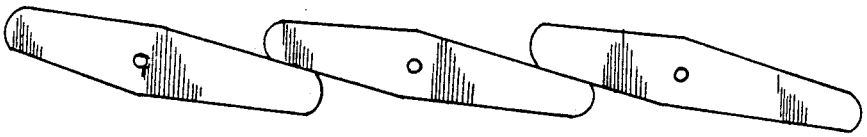
(PRIOR ART)
FIG. 6
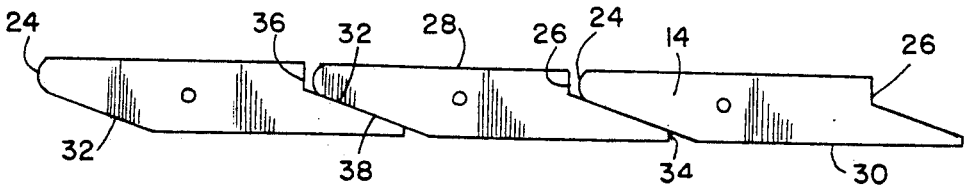

WOODEN MOVABLE LOUVER SHUTTERS

This is a continuation-in-part of patent application Ser. No. 07/205,921 filed 6/13/88, now abandoned.

BACKGROUND OF THE INVENTION

This invention relates to shutters, made primarily of wood with movable, manually adjustable louvers operating in unison and controlled by a tilt rod. This invention is restricted to improvements on a particular type of shutter commonly referred to as a "California style plantation Shutter" or sometimes as "Ante Eellum Shutters".

Its purpose is to improve upon this particular type of shutter so that, when the louvers are in the closed position, they lay flat and, by means of a rabbet, more effectively block out light and air, to cause the louvers to remain firmly in place after adjustments, and, above all, to cause it to operate like a piece of fine, precision machinery although made primarily of wood instead of metal.

In addition, its purpose is to make improvements in the device without changing any more than necessary, its outward appearance, the materials used—especially the "U" type, malleable metal staples—or its basic mechanical operation.

Strict consideration is given to the fact- that "California style Plantation Shutters" or "Ante Bellum Shutters" are used primarily for the purpose of beautifying the room in a classical manner, and their overall appearance cannot be altered. Their ability to control the influx of light and air is of secondary importance.

"California style Plantation Shutters" or "Ante Bellum Shutters", hereafter referred to as plantation shutters, which this invention attempts to improve upon, comprise a pair of spaced apart, vertical side rails or stiles and a plurality of horizontal louvers, each one having smoothly rounded margins and flat, or slightly curved or sloped, surfaces on top and bottom.

The louvers are rotably mounted in the side rails so that they can be adjusted between a closed position, an open position or any position in between.

Plantation shutters have a wooden rod, commonly called a tilt rod or adjusting rod. This tilt rod has "U" shaped, malleable, metal staples inserted into its underside which are coupled with a second set of similar staples inserted into the tops of the louvers, thereby causing them to rotate around their various pivot points when the tilt rod is moved.

In prior art plantation shutters the coupling of the staples is very slack which prevents the unit from operating in a precise, machine-like manner. It also prevents it from having the louvers remain firmly in place after adjustments. This invention improves upon this operation without materially changing its appearance or the materials used. This is accomplished by crimping the staples and forming a rabbet in the louvers.

Zittell made plantation shutters previous to 06/13/87 in which the staples in the tilt rod only were crimped and the louver staples were driven all the way into the louvers in order to prevent lateral movement in the coupling.

This invention is an improvement over Zittell prior to 06/13/87 in that the louver staples are not driven all the way into the louvers but, instead are allowed to stick out a short distance, similar to that of other plantation shutters. This allows the louver staples—as well as those inserted into the tilt rod—to be crimped, thereby forming a tight coupling made up of two interlocking eyelets.

A disadvantage of plantation shutters made by Zittell prior to 06/13/87 was the fact that, by crimping the staples inserted into the tilt rod only, the louvers remained firmly in place after movement to the closed position, and should they require adjustments, there was no means for doing so.

In prior art plantation shutters—those not made by Zittell—this did not present a problem. The slackness of the coupling allowed for considerable play within the staple coupling, thereby permitting the louvers to assume their proper positions when moved to the closed position. However, they did not remain firmly in place.

This invention improves upon Zittell prior to 06/13/87 in that, after final assembly of the shutter, the malleability properties of the staples allows the staples inserted into the louvers as well as those inserted into the tilt rod to be easily bent in either direction, thus providing a speedy and effective means for performing a uniform alignment of the louvers. This adjustment cannot be performed unless both set of staples extend a certain distance out of both the tilt rod and the louvers.

Another disadvantage of plantation shutters made by Zittell prior to 06/13/87, was the fact that, since that louver staples had been driven all the way into the louvers, there was no way for the tilt rod being laid on its side in order to facilitate painting its underside.

Zittell, prior to 06/13/87 felt that it was necessary to drive the louver staples all the way into the louvers in order to control lateral movement in the coupling, overlooking the fact that this could have been accomplished by crimping the louver staples in addition to the tilt rod staples.

In retrospect, this major improvement in the crimping of the staples in plantation shutters—namely: the crimping of both the louver staples as well as those inserted into the tilt rod—might be considered obvious, but apparently Zittell did no think of it until some time after 06/13/87 since he made shutters for a period of approximately five years previous to 06/13/87 without benefiting from the above mentioned advantages of crimping both sets of staples instead of just the single set inserted into the tilt rod.

Crimping of the staples makes no changes in the outward appearance of plantation shutters since both sets of staples, whether crimped or uncrimped, remain hidden behind the tilt rod at all times.

When the louvers of plantation shutters are moved to the closed position for the purpose of blocking out light and air, they overlap one another, each one slanted at a slight angle to the overall plane of the shutter, and they present a jagged appearance.

In order to cause the louvers to lie flat in the closed position, object #1, and, in addition, to be more effective in blocking out light and air when in that position, object #2, refer to Switzerland Pat. No. 206649 issued to Baumann.

Baumann accomplishes this by cutting rabbets in both the upper and lower margins of the louvers. The upper margin is considered the one containing the staple. The cutting of those two rabbets spoils the smooth, well rounded shapes of the louver extremities. This alteration in appearance of the upper margin will prove objectionable to "California style Plantation Shutters" or "Ante Bellum Shutters" customers when the louvers are moved to the open position. The open position is that position in which they will probably be set much of the time since, in that position, they are most attractive and beautify the room to its greatest extent.

The aforementioned two advantages contained in Baumann's patent would be best served by cutting a rabbet only in the lower margin of the louvers and a specially shaped formation on its upper margins scarcely different from that of the prior art plantation shutters.

The specially shaped louvers would lie flat when in the closed position and the rabbet would be hidden in that position. When the louvers are moved to the open position, this rabbet on the lower margin only, would move to the back, underside of the louver where it would be scarcely noticeable, while the upper margin moved to the front of the shutter which it presents its attractive, smooth, well rounded shape to the observe, almost indistinguishable from that of prior art plantation shutters.

SUMMARY OF THE INVENTION

The present invention is a shutter made primarily of wood with movable louvers operating in unison, controlled by a tilt rod with "U" shaped, malleable metal staples inserted into its underside, coupled to similar staples inserted into the upper margin of the louvers. The upper margin of the louver is considered to be that portion of the louver containing the staple and the front of the louver that position facing the observed when the louvers are in the closed position and the shutter in the normal upright position.

Strict compliance is given to the fact that this invention attempts to improve upon a particular type of shutter commonly called a "California style Plantation Shutter" or "Ante Bellum Shutter", hereafter termed a plantation shutter.

In prior art plantation shutters this coupling of the staples is very slack. In order to cause the device to operate like a piece of fine, precision machinery, although made primarily of wood instead of metal, and the louvers to remain firmly in place after adjustments, both the staples inserted into the tilt rod and those inserted into the louvers are crimped at a point just as close as possible to their junction points so as to form two tight, interlocking eyelets. Since the staples are made of a malleable metal it is easy to obtain a very tight coupling with no play whatever. The staples are of a type that has been used exclusively in prior art plantation shutters for many years during which they have remained basically unchanged. This shutter is concened with improvements in the shaping of this particular type of staple.

After final construction of the shutter, the malleability properties of the staple allows the staples inserted into the louvers, as well as those inserted into the tilt rod, to be easily bent in either direction, thus providing a speedy effective method for proper alignment of the louvers.

In order to cause the louvers to lie flat when in the closed position and to improve upon prior art plantation shutters in blocking out light and air when in that position, a unique louver shape has been devised.

In the present invention, the upper margin is made to slope inward and downward at a slight angle from a position about halfway through the total thickness of the upper margin to the lower surface of the louver.

At a position where the upper margin of the adjoining louver would make contact when the louvers are moved the closed position, a perpendicular cut is made to a position where it intersects a slope having the same angle as that of the upper margin. This slope continues in the lower margin to a position whereby it consumes most of the louver's thickness.

Thus a rabbet is formed, wherein the upper margin of each adjoining louver dovetails when the louvers are in the closed position. This rabbet formation makes the shutter more effective in blocking off light and air when in the closed position.

All edges are rounded.

This invention is an improvement over various inventions having rabbets, grooves and various other forms of indentation in both margin of the louvers in that this rabbet is formed only in the lower margin of the louver.

When the louvers are moved to the open position this rabbet moves inward and downward to a relatively inconspicuous position while the upper margin presents a smooth, well rounded edge where it is most noticeable. Thus, it presents the same pleasing outward appearance of prior art plantation shutters when in that position.

BRIEF DESCRIPTION OF THE DRAWINGS

The accompanying drawings illustrate the invention. In such drawings:

FIG. 4 is a perspective view of the prior art coupling assembly (Zittell prior to 06/13/87), illustratinq the fact that only the staples inserted into the tilt rod can be crimped;

FIG. 5 is a fragmented vertical sectional view of louvers of the prior art;

FIG. 6 is a fragmented vertical sectional view of louvers illustrating the novel features of the present invention;

DETAILED DESCRIPTION OF A PREFERRED EMBODIMENT

Figure 1:
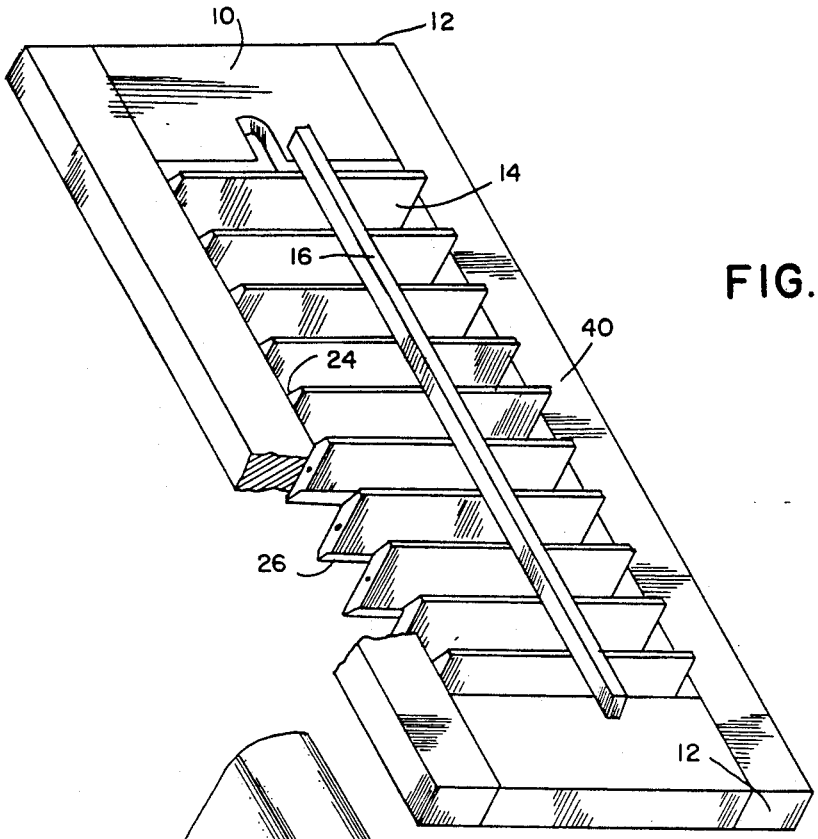
FIG. 1 is a perspective view illustrating a shutter in the open position and embodying the novel features of the louvers in the present invention.
Figure 8:
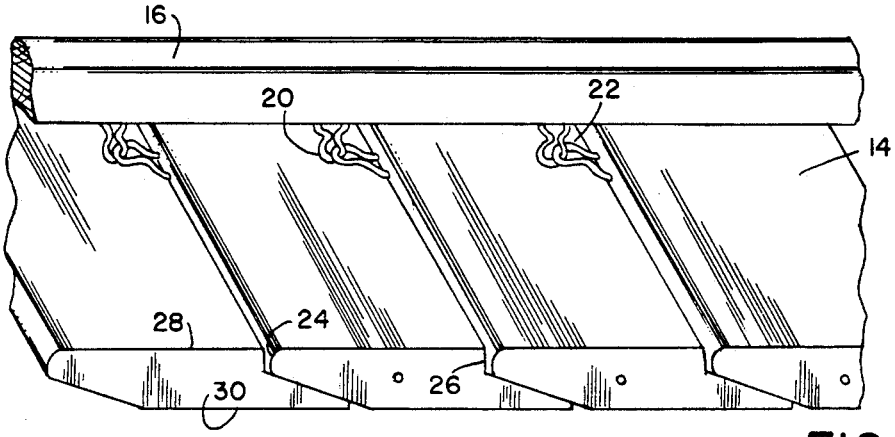
FIG. 8 is a perspective views showing arrangement of tilt rod, staples and louvers of the present invention when in the closed position.
Figure 9:
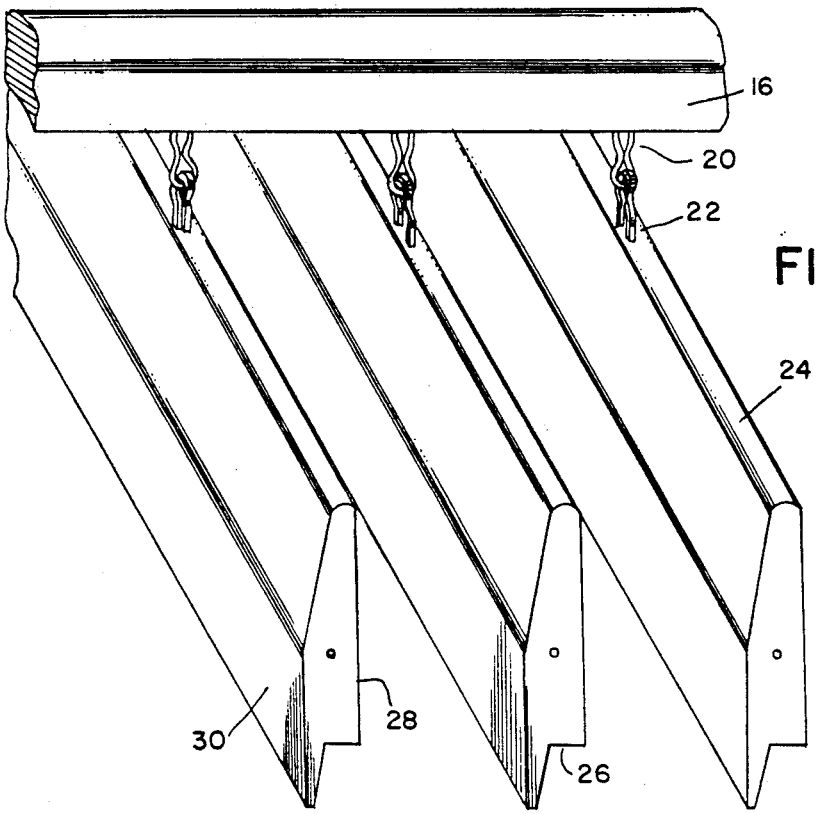
FIG. 9 is a perspective view showing arrangement of tilt rod staples and louvers of the present invention when in the open position.

As shown in the exemplary drawings, a shutter illustrated by overall drawing FIG. 1 includes a plurality of louvers 14 installed within a generally rectangular frame comprising stiles 12 and cross pieces 10 for movement between a closed position generally blocking passage of light and air, as shown in FIGS. 6 and 8 and an open position to permit passage of light and air as shown in FIGS. 1 and 9.

The upper margin 24 of the louver 14 is considered to be that portion containing the staple 20; the front 28 of the louver 14 is that section seen by the observer when the louvers 14 are in the closed position and the shutter is upright.

The shutter construction of the present invention provides a substantial improvement over prior art shutters commonly referred to as "California style Plantation Shutters" or "Ante Bellum Shutters" in that the staples 20, 22 are crimped. The staples 20 are inserted into tilt rod 16. The staples 22 are inserted into the upper margin 24 of louver 14. The staples 20, 22 are similar in appearance and composition to staples normally used in the construction of the aforementioned prior art shutters.

Figure 2:
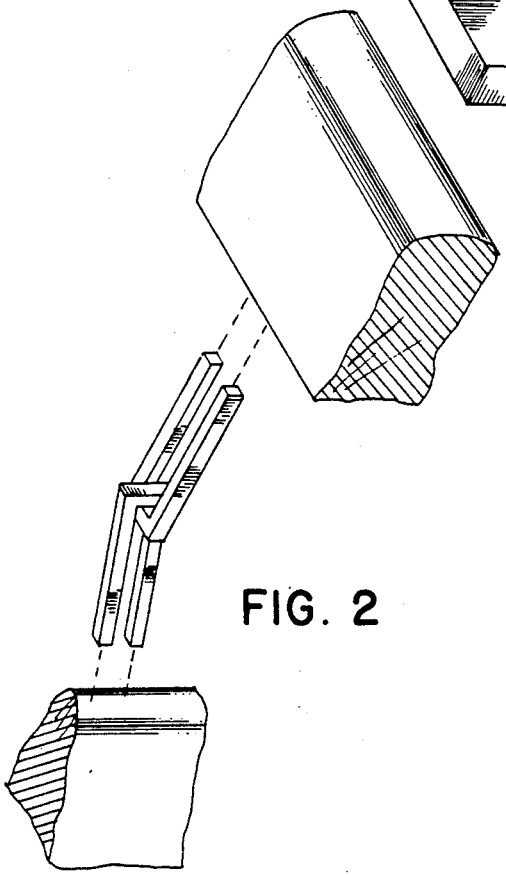
FIG. 2 (PRIOR ART)
FIG. 2 is a perspective view of the prior art coupling assembly illustrating the looseness of the coupling.
Figure 3:
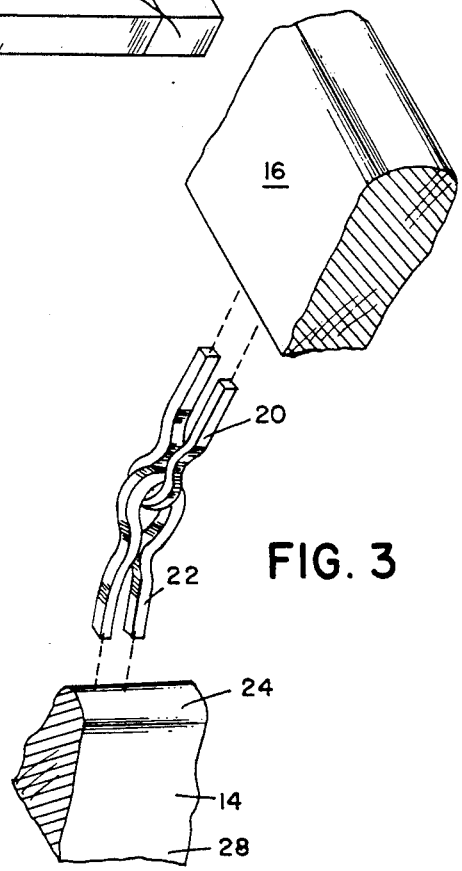
FIG. 3 is a perspective view showing the coupling of the staples in the present invention and how it becomes two tight interlocking eyelets.
Figure 7:
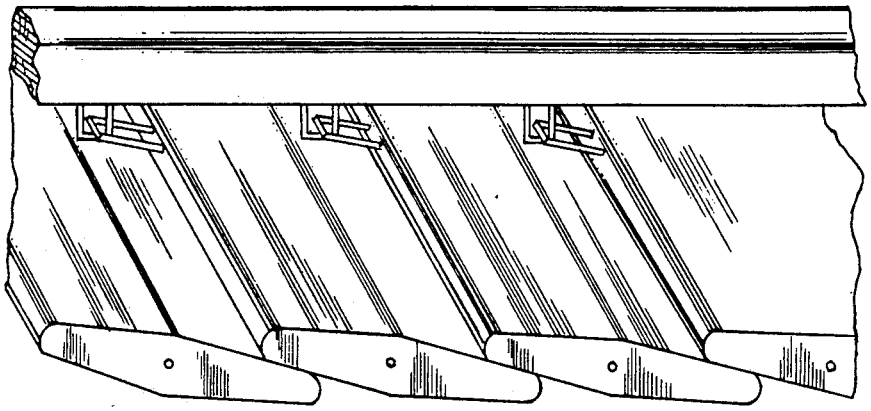
FIG. 7 (PRIOR ART)
FIG. 7 is a perspective view of the prior art showing arrangement of tilt rod, staples and louvers when in the closed position.

Since the staples 20, 22 are malleable and can be easily crimped, it is possible to press them firmly together so that there is formed a very tight coupling consisting of two interlocking eyelets and providing the maximum amount of static friction. This is illustrated by FIG. 3. FIG. 2 shows the prior art from wherein the staples provide a very loose form of coupling. By the crimping of the staples 20, 22 the unit operates in a very precise manner and remains firmly in place after adjustments.

Also, after final construction of the shutter, the malleability properties of the staples allows staples 20, 22 to be easily bent in either direction, thus providing a speedy and effective uniform alignment of the louvers 14 when the shutter is moved to the closed position.

FIG. 4 shows the prior art form (Zittell prior to 06/13/87) wherein only the tilt rod staples have been crimped. The louver staples have been driven all the way into the louver in order to prevent lateral movement within the coupling. Thus there is no way in which two interlocking eyelets could be formed. As a result there is no way to bend the staples in order to insure proper alignment of the louvers when the louvers are moved to the closed position. It should be noted that bending the tilt rod staples alone is ineffective in insuring the proper alignment of the louvers.

FIG. 4 also shows how it would be impossible to lay the tilt rod on its side in order to paint its underside.

FIGS. 6 and 8 depict louvers in the closed position and the shutter is horizontal. The closed position is defined as that position wherein the top surface 28 of the louver 14 is parallel to and on the same side as the top side 40 of stile 12, as depicted in FIG. 1. The upper margarine of the louver 14 is termed "upper" since, when the louvers are closed and the shutter is upright, the normal position for shutters, that is how it appears to the observer.

FIGS. 6 and 8 also show how the lower part of the upper section 32 of the louver 14 slopes downward and inward at an acute angle beginning at a position approximately half-way through the louver's thickness and continuing until it intersects the bottom surface 30 of the louver 14.

FIGS. 6 and 8 show the unique louver design wherein the louvers 14, when in the closed position, are scientifically designed to block out the maximum amount of light and air.

This is accomplished, firstly, because of a rabbet 26, located on the top side 28 of the louver at a point whereby the upper margin 24 of the adjoining louver dovetails loosely into this rabbet 26.

The rabbet 26 is made up of two surfaces—a vertical surface 36 extending downward perpendicularly from the top side 28 to where it intersects a sloping surface 38 parallel to the lower part of upper section 32, which continues downward and outward until it becomes a very narrow lower margin 34.

Secondly, the two contiguous surfaces—the lower part of upper section 32 and lower part of lower section 38—are as large in area as possible due to their diagonal slant.

Because of the large area of the contiguous surfaces plus the rabbet 26, the maximum possible amount of light and air screening is obtained.

The lower margin 34 of the louver 14 can become a very narrow surface without breaking since it is triangular in shape and becomes immediately thicker and stronger as it proceeds upward and inward.

All surfaces are rounded at their extremities.

FIGS. 1 and 9 show how the rabbet 26 assumes an inconspicuous position when in the open position while the upper margin 24 of the louver presents its smooth, well rounded shape to the observer.

Various modifications and improvement of the invention described herein are believed to be apparent to one of ordinary skill in the art. Accordingly, no limitations on the invention is intended except by way of the appended claims.

What is claimed is:

1. A louver shutter comprising:

two side members and two end members forming a frame: a plurality of louvers each having opposite upper and lower margins, and two opposite ends; a plurality of pivot points disposed in said side members, each pivot point supporting a respective end of a louver; a first plurality of staples arranged in a row, each staple inserted into the upper margin of a respective louver; a tilt rod; a second plurality of staples each inserted into said tilt rod in alignment with a respective one said first plurality of staples; wherein each of said staples of said first and second plurality of staples has a bight portion connected to spaced legs via intermediate portions, said intermediate portions extending inwardly of said spaced legs toward each other wherein said bight portion and said intermediate portions define an eyelet; and wherein each of said staples of said first plurality of staples is coupled by its eyelet with the eyelet of a respective staple of said second plurality of staples, for pivoting said louvers; and the eyelets remain locked together via the inwardly extending intermediate portions being crimped sufficiently together to prevent separation.

2. Louver shutter according to claim 1 wherein said staples are made of malleable metal.

3. Louver shutter according to claim 1, wherein said frame is rectangular, and said louvers are disposed in parallel with said end members.

4. Louver shutter according to claim 1 wherein at least one of said side members, end members, tilt rod, and louvers are made of wood.

5. Louver shutter according to claim 1, wherein only said lower margin of said louvers has a rabbet formed therein for receiving the upper margin of an adjacent lower louver.

6. Louver shutter according to claim 1, wherein said louvers are pivotable between an open and closed position.

7. Louver shutter according to claim 1, wherein when said shutter is in a horizontal position, the said side members having a top surface parallel to the top surface of the said louvers when the said louvers are in the said closed position, and wherein said louvers' top surfaces are disposed in a straight line when said louvers are in said closed position.

8. Louver shutter according to claim 7, wherein a surface extends at an acute angle from the said upper margin of the said louver and from a position approximately half-way through the total thickness of the said louver and intersects the bottom surface of said louver, said bottom surface being parallel to the said top surface.

9. Louver shutter according to claim 7, wherein a rabbet is formed only in said lower margin, at a position wherein the said upper margin of the adjoining louver loosely dovetails when said louvers are in said closed position.

10. Louver shutter according to claim 9 wherein the said rabbet is formed by having one side perpendicular to the said top side of the said louver and a second side parallel to the said surface which extends at said acute angle from the said upper margin of the said louver, and continuing downward and outward until it ends as a very small lower margin.

11. A louver shutter comprising:

two side members and two end members forming a frame: a plurality of louvers each having flat top and bottom surfaces, opposite upper and lower margins, and two opposite ends; a plurality of pivot points disposed in said side members, each pivot point supporting a respective end of a louver; a first plurality of staples arranged in a row, each staple inserted into the upper margin of a respective louver; a tilt rod; a second plurality of staples each inserted into said tilt rod in alignment with a respective one said first plurality of staples; wherein, when said shutter is in a horizontal position, the said side members having a top surface parallel to the top surface of the said louvers when the said louvers are in the said closed position, and wherein said louvers' top surfaces are disposed in a straight line when said louvers are in said closed position; wherein a single flat surface extends at an acute angle from the said upper margin of the said louver and from a position approximately half-way through the total thickness of the said louver and intersects the bottom surface of said louver, said bottom surface being parallel to the said top surface of said louver, wherein a rabbet is formed only in said lower margin at a position wherein the said upper margin of the adjoining louver loosely dovetails when said louvers are in said closed position.

12. Louver shutter according to claim 11 wherein the said rabbet is formed by having one side perpendicular to the said top side of the said louver and a second side parallel to the said single flat surface which extends at said acute angle from the said upper margin of the said louver, and continuing downward and outward until it ends as a very small lower margin.

* * * * *